United States Patent [19]

Hasenwinkle et al.

[11] 4,077,448

[45] Mar. 7, 1978

[54] IMPROVED EDGING SYSTEM

[75] Inventors: Earl D. Hasenwinkle, Longview; Ernesto M. Pangilinan, Seattle; Frank Wislocker, Longview, all of Wash.

[73] Assignee: Weyerhaeuser Company, Tacoma, Wash.

[21] Appl. No.: 645,742

[22] Filed: Dec. 31, 1975

[51] Int. Cl.[2] ..... B27C 1/08

[52] U.S. Cl. ..... 144/118; 83/368; 83/433; 90/17; 144/2 D; 144/117 B; 144/130; 144/323

[58] Field of Search ..... 83/360, 368, 371, 432, 83/433, 473, 477.1, 471.3; 90/17; 144/2 R, 2 D, 114 R, 116, 117 R, 117 A, 117 B, 118, 130, 134 R, 312, 319, 321, 314, 315 R

[56] References Cited

U.S. PATENT DOCUMENTS

| | | | |
|---|---|---|---|
| 963,697 | 7/1910 | Dyer | 144/130 X |
| 2,918,950 | 12/1959 | LeTarte | 83/471.3 |
| 3,276,492 | 10/1966 | Kervefors | 83/368 X |
| 3,388,727 | 6/1968 | Kotila | 144/1 R X |
| 3,554,247 | 1/1971 | Larsen | 144/117 B |
| 3,710,836 | 1/1973 | Busch | 83/471.3 X |

FOREIGN PATENT DOCUMENTS

| | | | |
|---|---|---|---|
| 114,349 | 12/1941 | Australia | 83/433 |

*Primary Examiner*—Othell M. Simpson
*Assistant Examiner*—W. D. Bray

[57] ABSTRACT

An edging system for machining the opposed rough edges of a workpiece into a parallelogram having the optimum angle of cut has an upstream sensing station to detect the maximum available width in order to remove the least amount of material. At the edging station a pair of laterally adjustable opposed cutter heads are mounted on a rotatable frame so as to have both the lateral distance between cutter heads and the angle the cutter heads make with respect to the top and bottom surfaces of the workpieces variable. Suitable conveying surfaces transport the workpiece into, through, and away from the edging station.

10 Claims, 6 Drawing Figures

CONTROL SYSTEM

IMPROVED EDGING SYSTEM

BACKGROUND OF THE INVENTION

This invention relates generally to a method and apparatus for machining rough edged wooden workpieces into parallelograms. The invention relates more specifically to the method and apparatus for machining wooden workpieces having rough edges at varying angles from the top and bottom surfaces and variable widths into the shape of parallelograms having substantially flat surfaces and maximum cross sectional areas.

In the lumber industry, when a cylindrical log is cut into a plurality of longitudinally extending pieces at least some of the pieces will have curvilinear edges. Since lumber is normally used in rectangular form the curvilinear edges must be removed by a machining process known as edging. Generally, edging refers to that process whereby a rough piece of lumber has its opposed rough edges machined to flat surfaces at some predetermined width. Common dimension lumber is generally sold in 4, 6, 8, 10, and 12 inch widths and therefore the edging process will usually yield one of these dimensions. The object in edging boards is to produce a rectangular piece having the maximum obtainable width consistent with given edging rules and product requirements.

In the process of cutting a log into a plurality of sector-shaped pieces and then bonding two similarly sized sector-shaped pieces together to a predetermined thickness, thin edge to thick edge, to form a board in the shape of a rough parallelogram, it becomes necessary as a subsequent step in making usable lumber, to edge the opposed sides of the rough parallelogram. By edging the rough parallelogram, it is meant that the two opposed slanting edges of the composite board will be machined into parallel flat surfaces according to a substantially automatic dimension maximizing process. After the composite boards are edged to their maximum obtainable width, a plurality of them having appropriate dimensions can then be edge bonded together to form wider width composite members. Such a process is substantially less wasteful of wood fiber and results in a considerably higher yield of lumber from a given log, especially smaller logs. The process of forming composite lumber products from sector-shaped pieces is fully disclosed in the commonly assigned U.S. Pat. No. 3,961,654. A similar process where rough parallelograms would be formed is disclosed in U.S. Pat. No. 3,903,943 also commonly assigned. The disclosures of the commonly assigned U.S. patents are incorporated herein by reference in order to provide a complete description and understanding of the present invention.

Two variables in the resulting rough parallelograms must be considered in the edging process. One is the width of the parallelogram and the other is the angle formed between a longitudinal plane normal to the top and bottom surfaces and a longitudinal plane passing through the top and bottom edges on each side of the parallelogram. These variables are caused by cutting sector-shaped pieces from logs of varying diameter. While the rough parallelograms will have substantially the same thickness, the width and above defined angle may vary. Accordingly, an apparatus to carry out the edging process must be capable of adjustment to account for the two variables. Ideally, the adjustments will be made automatically based on upstream sensing of the variables and control of the cutter heads making the edging cuts.

In a production environment it is desirable to provide for continuous operation where the workpieces will be traveling at an efficient rate of speed while the variables are sensed and the edging step carried out. Reliability of the equipment is also desirable as is a low capital cost.

Accordingly, from the foregoing, the primary object of the present invention is to machine from a rough elongated workpiece a surfaced piece having flat surfaces with the maximum obtainable width and in the shape of a parallelogram.

Another object of the present invention is to carry out such a machining or edging step in a substantially automatic manner.

These and other objects of the present invention will become apparent upon reading the following specification while referring to the attached drawing.

SUMMARY OF THE INVENTION

Briefly stated, this invention is practiced in one form by sensing the width of an incoming workpiece having rough slanted edges and then utilizing the resulting signal to control the distance between a pair of opposed cutter heads whereby they will be set a distance apart corresponding to the maximum obtainable width. The opposed cutter heads are substantially parallel with respect to one another and are rotatable as a unit about an axis generally corresponding with the direction of travel of the workpiece in order to vary the angle they establish with the top and bottom surfaces of the workpiece. For each incoming workpiece, the angle of the edging cut is determined that minimizes the amount of material to be removed consistent with forming a surfaced parallelogram of maximum width. Suitable conveyor surfaces support the workpiece as it travels through the edging station while a series of hold-down rolls constrain the workpiece in its proper orientation as is passes through the edging station.

DESCRIPTION OF THE PREFERRED EMBODIMENT

General Assembly of Edging System

Figures 1, 2, 3:
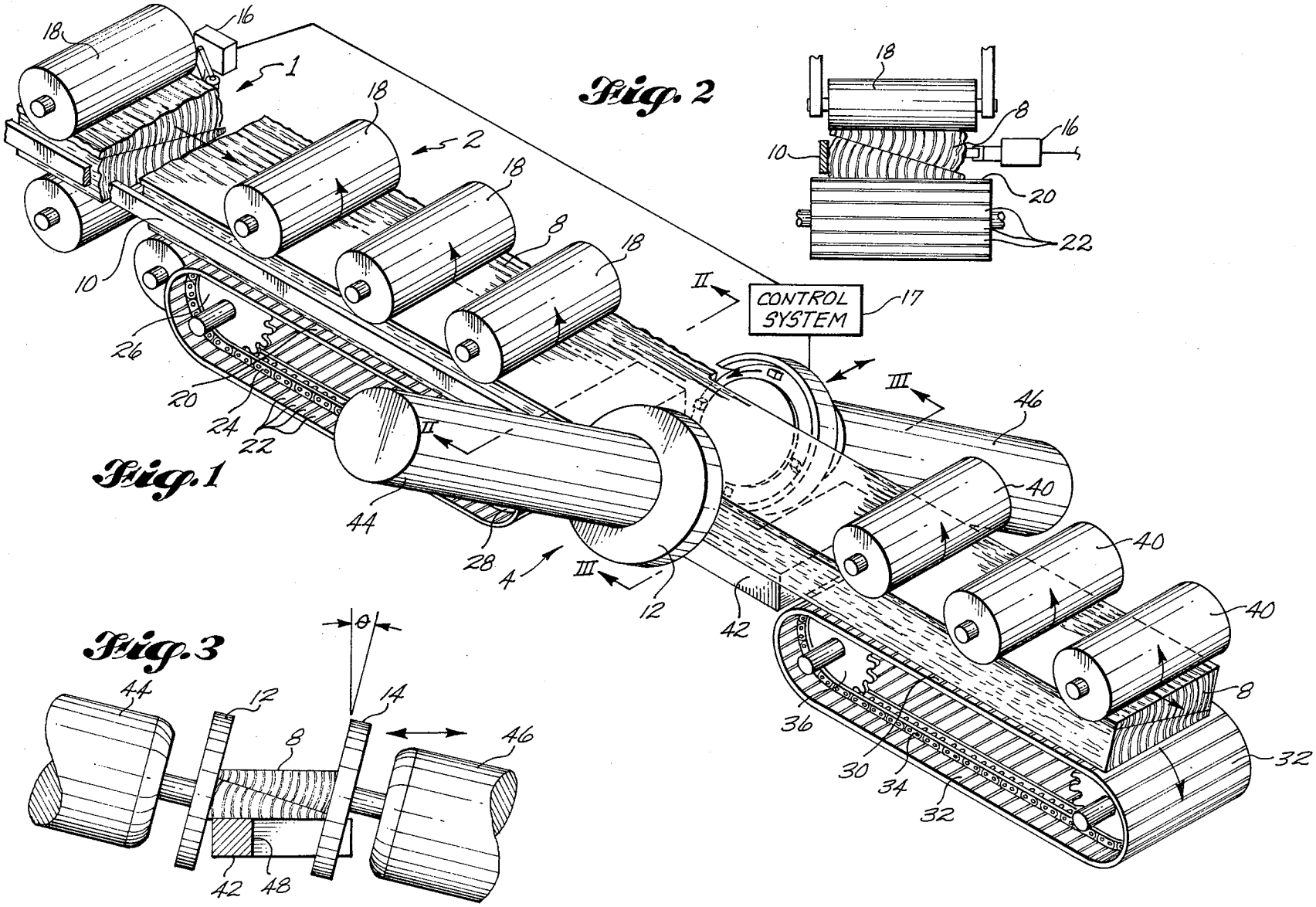
FIG. 1 is a schematic representation in perspective of the present invention.
FIG. 2 is a cross-sectional view taken along line II—II of FIG. 1 showing the type of workpiece to be edged.
FIG. 3 is also a cross-sectional view taken along line III—III and depicts the cutting heads edging the rough slanted portions of the workpiece.

Referring first to FIGS. 1-3, a general description will be given together with the overall operating environment of the invention. The edging system, as generally depicted in FIG. 1, is comprised of an upstream sensing station 1, an infeed section 2, an edging station 4, and an outfeed section 6. It will be recognized by those skilled in the art that the general function of the infeed and outfeed sections is to transport elongated workpieces 8, having substantially parallel top and bottom surfaces with rough opposed edges, along a certain accurate path of travel, into, through, and away from edging station 4. The infeed and outfeed sections are generally known in the art and any suitable means for carrying out the conveying function is within the contemplation of the present invention although a specific infeed and outfeed will be described.

Extending longitudinally along one edge of both the sensing station 1 and infeed section 2 and for a distance upstream therefrom is line bar 10. Before a workpiece 8 is conveyed past sensing station 1 and into infeed section 2, it will be compelled to move laterally so that one rough edge abutts line bar 10. The line bar 10, as will be recognized by those skilled in the art, forms a reference plane and is utilized for measuring and guiding purposes in order to set the adjustable cutter heads 12, 14 at edging station 4 for proper edging of workpiece 8.

The objective at the upstream sensing station 1, which is comprised of any suitable position sensing and transducer means 16, such as an arm rotating a shaft encoder, is to detect the variable widths of incoming workpieces 8 having rough opposed edges. Sensing means 16 generates a continuous signal as each rough workpiece passes proportional to the position of the edge being sensed with respect to line bar 10. The signal representing the minimum distance over the length of each workpiece from line bar 10 to the opposite edge is selected and serves as the signal to set the lateral distance between cutter heads 12, 14 through control system 17.

The infeed section 2 in addition to the hold-down rolls 18 includes an infeed conveying surface indicated generally at 20. It may be a typical slat bed feedworks comprised of a plurality of individual slats 22 which are mounted on an endless chain 24 which in turn is driven by a pair of longitudinally spaced sprockets 26, 28. Once workpiece 8 is positioned so as to travel against line bar 10 ahead of sensing station 1, it is then desirable to hold the workpiece in that position as it travels into and past edging station 4. The slat bed feedworks in combination with hold-down rolls 18 minimizes lateral deviation.

Similarly, the outfeed section 6 includes a bottom outfeed conveying surface 30 which is comprised of a plurality of individual slats 32 mounted on endless chain 34. Endless chain 34 is likewise driven by a pair of spaced sprockets 36, 38. Additionally, in order to constrain the now partially edged parallelogram as it travels through outfeed section 6 a plurality of outfeed hold-down rolls 40 are provided. The directional arrows indicated on the several hold-down rolls and conveying surfaces are as would be expected in order to convey a workpiece longitudinally through edging station 4.

The edging station 4 includes a generally flat anvil member 42 which is in the same horizontal plane as the conveying surfaces 20, 30 and in line therewith. As can be seen by referring to FIG. 1, the anvil member 42 provides the supporting surface for workpiece 8 as it travels through edging station 2. Providing the actual machining of workpiece 8 are the pair of laterally opposed, substantially parallel cutter heads 12, 14. Each cutter head 12, 14 can be comprised of any suitable cutting element such as a saw, chipping head, or a conventional planing element. The primary purpose of the cutter heads is to convert the rough slanted edges into edges having substantially flat parallel surfaces. Suitable motor means 44, 46 are directly connected to each cutter head 12, 14 in order to provide the torque to drive the heads. It will be noted here and described in greater detail later that cutter head 12 is positioned substantially in line with the line bar 10 while the other cutter head 14 is mounted in such a way that its lateral position may be varied in response to the sensed width of the incoming workpiece. In order to accommodate cutter head 14 in its lateral movement, a generally rectangular cutout portion 48 is provided within anvil member 42. Cutter head 14 is therefore free to move towards or away from the opposing cutter head without hindrance from anvil member 42 (see FIG. 3). As previously mentioned, it is control system 17 that accepts the incoming signals from sensing station 1 and then acts to control the lateral position of cutter head 14.

Figure 4:
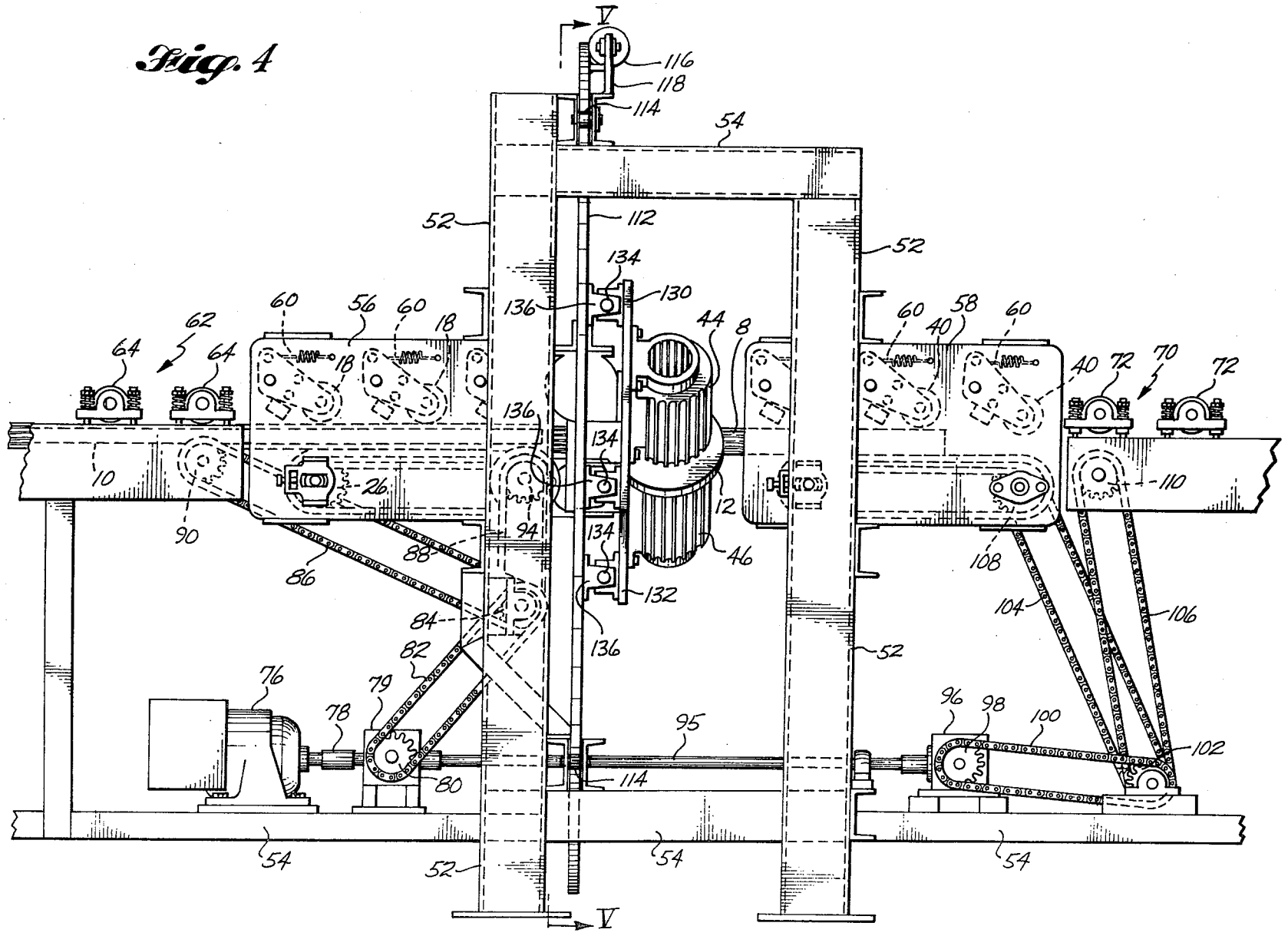
FIG. 4 is a side elevation view along line IV—IV of FIG. 5 showing the infeed section, the edging station, and the outfeed section.
Figure 5:
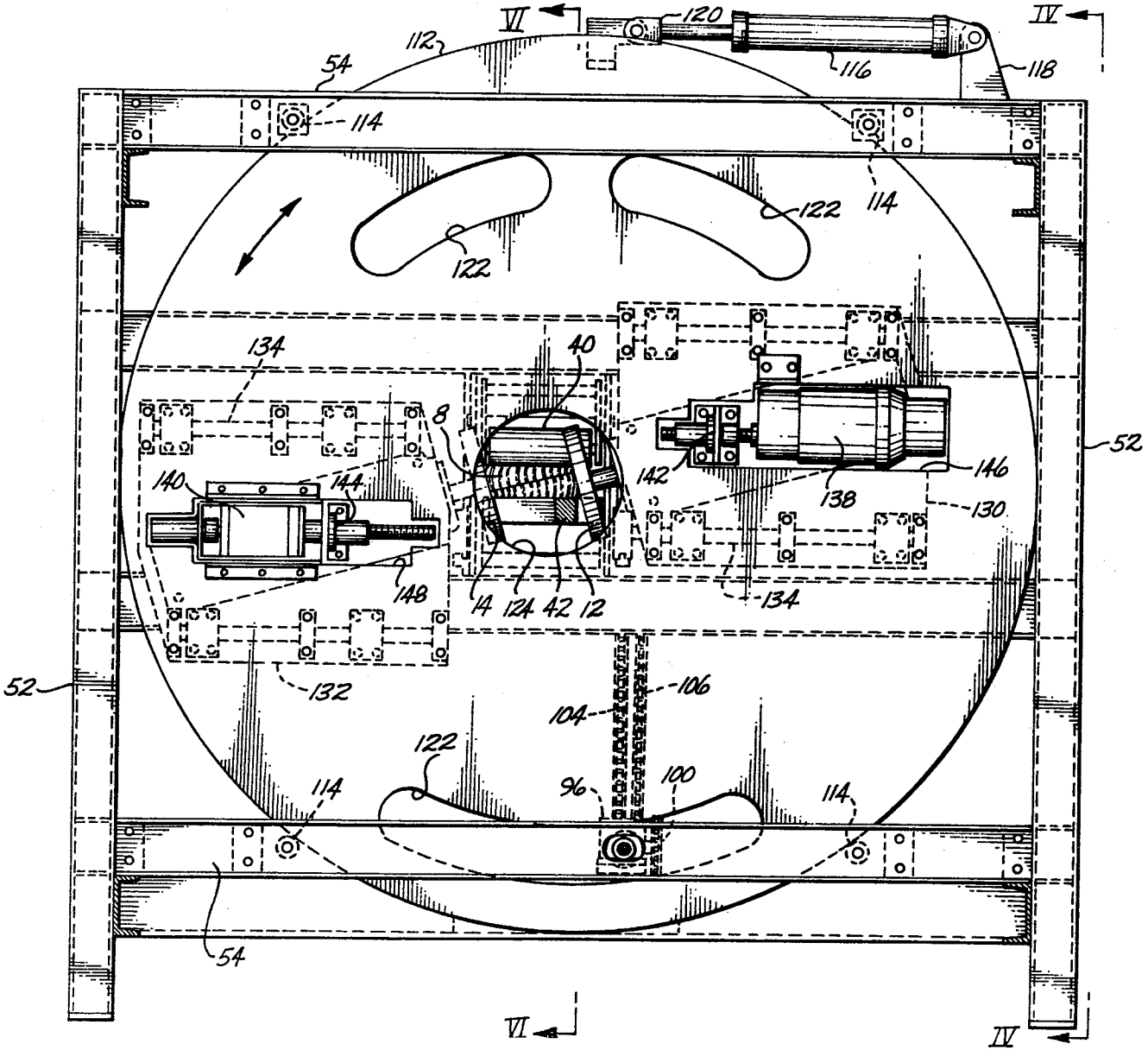
FIG. 5 is a sectional view taken along line V—V of FIG. 4 and shows the rotatable frame on which are mounted the cutting heads together with additional details of the edging station.
Figure 6:
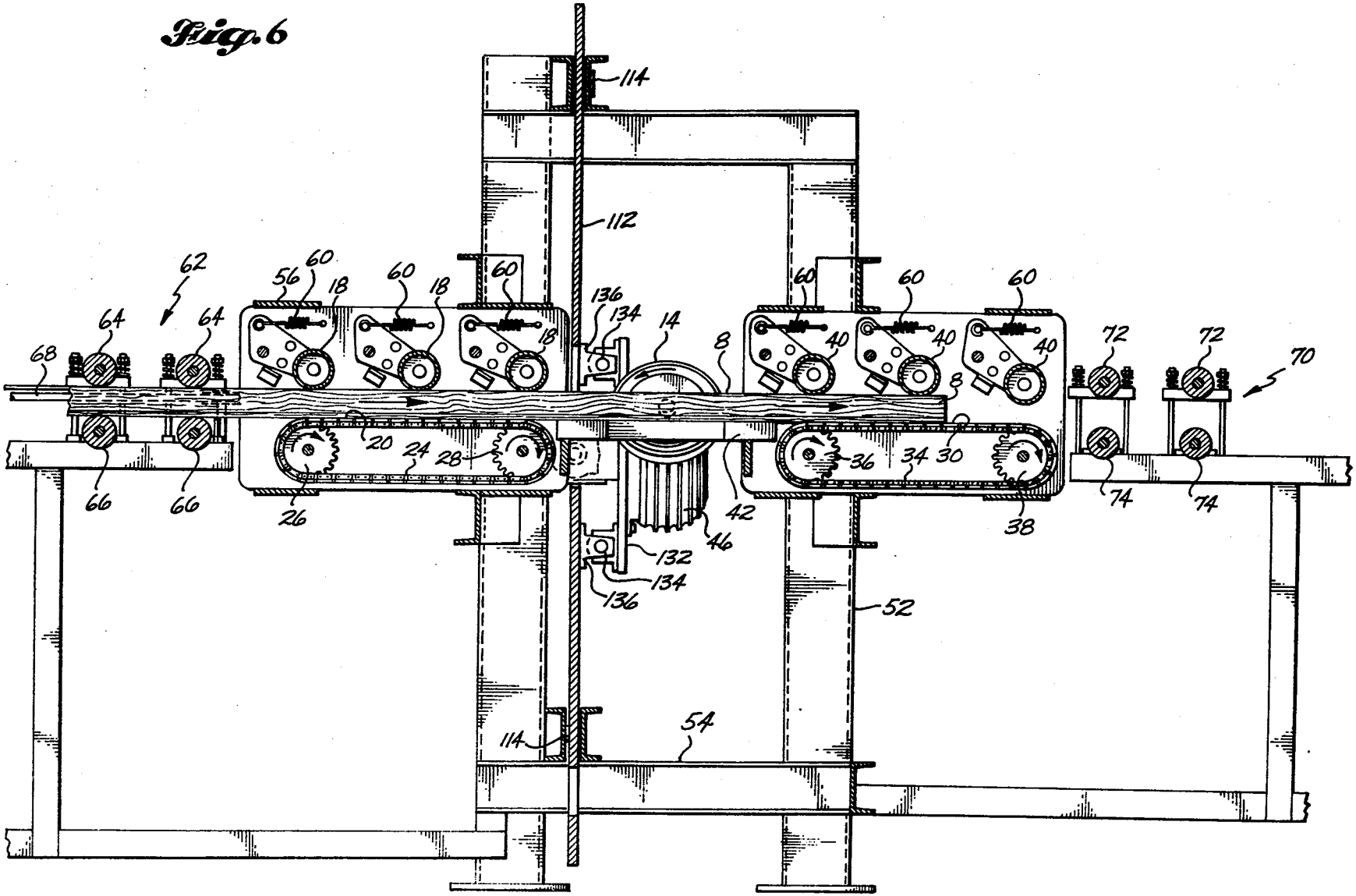
FIG. 6 is a cross-sectional view taken along line VI—VI of FIG. 5 and shows the workpiece being transported through the edging station.

Turning now to FIGS. 4–6, a frame structure is provided to support the infeed and outfeed sections and edging station 4 in their proper in-line relationships. The frame structure is comprised of a plurality of vertical structural elements 52 together with a plurality of horizontal structural elements 54. The infeed and outfeed sections are enclosed within enclosure means 56, 58, respectively, primarily for safety reasons. The enclosure means 56, 58 may be of any suitable structure that generally surrounds both the bottom conveying surfaces and the top hold-down rolls. The infeed and outfeed hold-down rolls 18, 40 are biased through biasing means 60 in order to exert a suitable pressure on the top surface of traveling workpieces 8. The design for suitable hold-down rolls is well known and will not be further described.

As depicted in FIGS. 4 and 6 there is positioned upstream from the infeed section 2, in addition to sensing station 1, further feed mechanism generally indicated at 62. In addition to consisting of the previously described line bar 10, feed mechanism 62 may also be comprised of a plurality of opposed top and bottom feed rolls 64, 66. Feed rolls 64, 66 cause the incoming workpiece to travel in the longitudinal direction past sensing station 1 and into infeed section 2. As depicted in FIG. 6, a longitudinally extending guiding means 68 is provided along the workpiece edge opposite to the edge abutting line bar 10. Guiding means 68 is designed so as to urge the workpiece 8 against line bar 10 as it travels forward. Similarly, a further outfeed mechanism 70 is positioned downstream from the outfeed section 6 in order to continue carrying and directing the workpiece through and away from edging station 4. The outfeed mechanism 70 is likewise comprised of pairs of opposed top and bottom feed rolls 72, 74.

Providing the means to drive the respective conveying elements in the overall edging system is motor 76. Motor 76 through drive shaft 78 and a gear box 79 turns sprocket wheel 80 which in turn, through drive chain 82, turns a triple sprocket wheel 84. Sprocket wheel 84 has extending therefrom two drive chains 86, 88. Drive chain 86 acts to turn a sprocket wheel 90 which in turn is connected to and drives a bottom infeed roll 66. The drive chain 88 is similarly trained about a sprocket wheel 94 which is on the same shaft as sprocket 28, thereby serving to drive the infeed conveying surface 20.

An additional drive shaft 95 extends longitudinally from gear box 79 to a second gear box 96 which is positioned beneath the outfeed conveying surface 30. A sprocket wheel 98 extends from gear box 96 and has a drive chain 100 extending therefrom to a longitudinally spaced triple sprocket 102. Attached to the same shaft as sprocket 102 are two other sprocket wheels (not shown) which serve to turn drive chains 104, 106 which in turn are trained about sprocket wheels 108, 110 in order to drive the outfeed bottom conveying surface 30 and bottom outfeed roll 74.

Edging Station

To be described in detail now is the mechanism comprising the edging station 4. A generally circular frame 112 is oriented in a vertical plane and is rotatable about an axis along which workpieces 8 are conveyed. Frame 112 is mounted on a plurality of bearing members 114 which in turn are mounted on the horizontal structural elements 54. The mounting means for frame 112 is designed to constrain the frame within a fixed vertical plane yet to allow it to rotate about its axis. Serving to provide the rotational movement to frame 112 is an actuating cylinder 116 horizontally mounted on one of the top structural elements 54. Actuating cylinder 116 is pivotally mounted through mounting means 118 to structural element 54, while at its other end cylinder 116 is attached to rotatable frame 112 through suitable pinned connection means 120. Actuating cylinder 116 can be of any suitable type which can be adapted to rotate frame 112 through discrete preselected angles. Means (not shown) to lock the frame in place at a selected angle $\theta$ (inclined angle of cut or angle made by cutter heads with respect to a longitudinal vertical plane) may also be provided to ensure accurate edging during operation.

A plurality of apertures 122 may be provided within the body of frame 112 consistent with weight and strength requirements. A central aperture 124 is provided in frame 112 and is sized such that the largest workpiece to be edged will clearly pass through it when the frame is at any angular position.

As previously noted, the opposed cutter heads 12, 14 are positioned relative to each other in parallel orientation. Their lateral spacing as well as their angular orientation with respect to a vertical plane through the direction of travel is variable. The cutter head assemblies consisting of the cutter heads 12, 14 and their corresponding motors 44, 46 are fixedly mounted cn flat plates 130, 132 with the flat plates in turn being slidably mounted on parallel linear bearings, each being indicated as 134. The linear bearings 134 are fixedly attached through attachment means 136 to the rotatable frame 112. The cutter head assemblies are laterally positioned on the linear bearings by any suitable linear positioning means and in the present embodiment is comprised of stepper motors 138, 140 and ball screw means 142, 144. The stepper motors 138, 140 are fixedly mounted to the rotatable frame 112 within apertures 146, 148 while ball screw means 142, 144 are drivably attached to flat plates 130, 132.

The cutter heads 12, 14 are mounted at an angle of 15° with respect to the linear bearings 134. It should thus be apparent that when the edging station is set to machine an incoming workpiece, where the inclined angle of cut $\theta$ is 15° from vertical, the linear bearings will be in horizontal planes. Also the frame 112 is mounted so as to rotate about a center point at the center line of cutter head 12 thereby resulting in minimum variation in a horizontal plane to cutter head 12. It is thus apparent that the center line of the other cutter head 14 will move vertically as frame 112 is rotated, however, it will still maintain its parallel relationship with cutter head 12. This arrangement helps to minimize errors or differences in the sensed width of a workpiece compared to the cutter width and to approximately center the cutter heads with respect to the workpiece for any preselected angle $\theta$.

Operation of the Invention

A typical cross-section of a workpiece to be machined is depicted in FIG. 2. As previously noted the workpiece may be comprised of a pair of sector-shaped wooden pieces bonded together such that the thin edge of one is approximately adjacent the thick edge of the other with the top and bottom surfaces being substantially parallel. When the sector-shaped pieces are cut from a log segment, each will have a curvilinear portion representing a portion of the log's surface. Since it is desirable for most wood products to have flat surfaces, the two opposed edges of the thusly formed workpiece will be machined into flat surfaces. In order to conserve wood fiber in solid form, one approach in edging such a workpiece is to remove as little fiber as possible consistent with future end uses. The largest piece in cross-sectional area with flat surfaces that can be machined from an incoming workpiece is therefore a parallelogram.

At the upstream sensing station after the workpiece has been positioned laterally so that one edge is abutting the line bar, the sensing means acts to determine the maximum variation of the other edge with respect to the line bar. This information is translated into a digital signal (corresponding to the minimum distance) which is then used to set the lateral position of cutter head 14 through control system 17. The appropriate signal actually serves to actuate stepper motor 140 which in turn drives ball screw means 144, thereby moving flat plate 132 and consequently the cutter head 14. While the embodiment depicted in the figures shows only one automatically set cutter head, the other cutter head 12 being at a predetermined position with respect to the line bar, it is apparent that the other edge could also be detected and the cutter head set accordingly. Even though the operator usually places the straightest edge adjacent line bar 10, an incremental jog means may be provided for cutter head 12 in order to remove more or less wood fiber at the operator's discretion.

Assuming that the lateral distance between the two cutter heads 12, 14 has been automatically determined and set by positioning cutter head 14 to yield the widest width for the resulting parallelogram, it is then necessary to set the angle $\theta$. This set may be done automatically through appropriate sensing means, but in the present embodiment it is done by an operator visually observing the incoming workpiece and determining the appropriate angle for setting the cutter heads. Usually in a production run a substantial number of like workpieces will be machined during a given time period, thereby minimizing the number of angular sets. Once the operator determines the angle $\theta$ he directs a signal to the actuating cylinder 116 in order to rotate frame 112 and cutter heads 12, 14 into proper position. The angular sets can be infinitely variable or there can be a predetermined number of sets depending upon the desired flexibility of edging.

Depending upon the type of sensing means used to sense the maximum width variation of an edge, it may be necessary to provide an electronic bias within the control system to correct for actual cutter head position. The bias may be automatically set as frame 112 is rotated to the desired angle $\theta$. This bias is necessitated by the fact that the frame rotates about an axis which is at the center point of cutter head 12. With such a design the rotating axis of the other cutter head as previously noted is then required to move vertically depending upon the angle $\theta$ to be set.

After the two sets are made providing the proper positioning for cutter heads 12, 14 the workpiece 8 will then be conveyed through edging station 4 to thereby form a parallelogram. An appropriate gap is provided between workpieces to allow sufficient time for setting the lateral distance between cutter heads 12, 14 and rotation of frame 112 to selected angle $\theta$. Workpiece position limit switches acting to control conveyor surfaces can easily establish the necessary gaps.

While a detailed example of the principle embodiment has been described, it is understood that many changes and modifications may be made in the above-described edging system without departing from the spirit of the invention. All such modifications are intended to be included within the scope of the appended claims.

What is claimed is:

1. In an edging system of the type having a pair of substantially parallel, laterally spaced, adjustable cutter heads for machining the edges of an elongated workpiece moving longitudinally through and relative to the edging station, the improvement comprising:

means to adjust the lateral spacing between the cutter heads in response to the width of an incoming workpiece, and means to adjust the angular orientation of the cutter heads with respect to a longitudinally extending, substantially vertical reference plane while maintaining their substantially parallel relationship.

2. The improvement as in claim 1 which includes a rotatable frame for supporting the cutter heads in their substantially parallel relationship when their angular orientation is uniformly adjusted.

3. The improvement as in claim 2 in which the frame rotates about a longitudinal axis approximately coinciding with the center line of a workpiece.

4. The improvement as in claim 2 in which the cutter heads are slidably mounted on the rotatable frame in order to provide for the lateral adjustment between cutter heads.

5. The improvement as in claim 1 which includes sensing means for detecting the maximum obtainable width of an incoming workpiece and control means for adjusting the lateral spacing between the cutter heads in response thereto.

6. The improvement as in claim 1 which includes a longitudinally extending referencing means for determining the lateral position of one edge of a workpiece as it moves through the edging station.

7. The improvement as in claim 6 in which the referencing means is a longitudinally extending line bar.

8. The improvement as in claim 7 in which one of the cutter heads is angularly adjusted about a longitudinal axis substantially coinciding with the line bar.

9. The improvement as in claim 8 in which the other cutter head is angularly adjusted about the same axis while being supported and spaced apart from the axis.

10. The improvement as in claim 1 further including means to prealign the incoming workpiece and to constrain it in its prealigned path of travel.

* * * * *